US010414029B2

(12) United States Patent
Mills et al.

(10) Patent No.: US 10,414,029 B2
(45) Date of Patent: Sep. 17, 2019

(54) RATCHET WRENCH

(71) Applicant: Tribus Innovations, LLC, Spokane Valley, WA (US)

(72) Inventors: Tommy Mills, Deaver, WY (US); Jay Ayala, Hillsboro, OR (US); Kendall Bertagnole, Spokane Valley, WA (US)

(73) Assignee: Tribus Innovations, LLC, Spokane Valley, WA (US)

( * ) Notice: Subject to any disclaimer, the term of this patent is extended or adjusted under 35 U.S.C. 154(b) by 339 days.

(21) Appl. No.: 15/092,056

(22) Filed: Apr. 6, 2016

(65) Prior Publication Data

US 2017/0291286 A1 Oct. 12, 2017

(51) Int. Cl.
*B25B 13/48* (2006.01)
*B25B 13/46* (2006.01)

(52) U.S. Cl.
CPC ..... *B25B 13/481* (2013.01); *B25B 13/463* (2013.01)

(58) Field of Classification Search
None
See application file for complete search history.

(56) References Cited

U.S. PATENT DOCUMENTS 2,620,694 A * 12/1952 Jansson ..... B25B 1/125 269/193
2,772,763 A * 12/1956 Johnson ..... B25B 13/465 192/43.1
3,175,434 A 3/1965 Bergquist
7,263,919 B2 9/2007 Arnold
8,950,293 B2 2/2015 Hu
2006/0123954 A1* 6/2006 Arnold ..... B25B 13/463 81/63
2010/0101376 A1 4/2010 Chen
2010/0212461 A1 8/2010 Burt
2010/0257979 A1 10/2010 Zhan
2011/0113930 A1* 5/2011 Liao ..... B25B 13/08 81/58.2
2011/0209583 A1 9/2011 Hsieh
(Continued)

OTHER PUBLICATIONS

KHKGears Pitch Figure, found at https://khkgears.net/new/gear_knowledge/abcs_of_gears-b/basic_gear_terminology_calculation.html, Apr. 2018, attached as pdf.*
(Continued)

*Primary Examiner* — Brian D Keller
(74) *Attorney, Agent, or Firm* — Lee & Hayes, P.C.

(57) ABSTRACT

A wrench including a ratchet and first and second pawls in an end of the wrench. The ratchet having a first array of gripping members, the first pawl having a second array of gripping members, and the second pawl having a third array of gripping members. The second array of gripping members of the first pawl offset relative to the third array of gripping members of the second pawl, and the offset about doubling a pitch of the first array of gripping members of the ratchet to decrease a rotation of the wrench by about half. Each array of the first, second and third arrays of the gripping members having a first curvilinear surface in a first direction and a second curvilinear surface in a second direction different than the first direction to maximize a gripping surface area and increase an amount of torque the wrench may apply.

18 Claims, 7 Drawing Sheets

(56) References Cited

U.S. PATENT DOCUMENTS

| | | | | |
|---|---|---|---|---|
| 2012/0297934 | A1* | 11/2012 | Peirce | B25B 13/461 81/60 |
| 2013/0269488 | A1* | 10/2013 | Huang | B25B 13/463 81/60 |
| 2014/0311300 | A1* | 10/2014 | Chen | B25B 13/463 81/63.1 |

OTHER PUBLICATIONS

PCT Search Report and Written Opinion dated Jun. 29, 2017 for PCT Application No. PCT/US17/23224, 8 pages.

* cited by examiner

RATCHET WRENCH

BACKGROUND

Working a wrench in a confined space may be difficult and time consuming. This is particularly true where obstructions in a confined space prevent rotation of a wrench attempting to loosen or tighten a fastener disposed in the confined space. For example, multiple transmission lines, multiple fuel lines, multiple brake fluid lines, multiple power steering lines, multiple pneumatic lines, etc. may be positioned adjacent to each other in a transmission, an engine, a carburetor, a brake system, a power steering unit, a refrigeration system, etc. And, these lines may hinder or prevent existing flare-nut wrenches, tube wrenches, line wrenches, etc. having a minimum rotation, from loosening or tightening a flare fitting or flare nut coupled to one of these multiple lines.

Accordingly there remains a need in the art for a wrench that has a smaller minimum rotation than the minimum rotation of existing wrenches, and allows a user to loosen or tighten a fastener in a confined space.

SUMMARY

Generally, the wrenches according to this application are configured to loosen or tighten fasteners. The wrenches may be particularly suited for fasteners disposed in confined spaces. In some instances, the wrenches include a ratchet mechanism having a ratchet and first and second pawls that are offset and cooperate with the ratchet. The first and second pawls are offset relative to each other and about double a gripping member (e.g., a projection, a cog, a tooth) pitch of the ratchet to decrease an amount of a rotation of the wrench needed to rotatably displace a fastener in a confined space. This summary is provided to introduce simplified concepts of wrenches, which are further described below in the Detailed Description. This summary is not intended to identify essential features of the claimed subject matter, nor is it intended for use in determining the scope of the claimed subject matter.

In one example embodiment, a wrench includes a ratchet disposed in a first receptacle in an end of the wrench, a first pawl disposed in a second receptacle in the end of the wrench, and a second pawl disposed in a third receptacle in the end of the wrench. The ratchet is rotatably displaceable in the first receptacle and includes a first array of gripping members, the first pawl is displaceable in the second receptacle and includes a second array of gripping members, and the second pawl is displaceable in the third receptacle and includes a third array of gripping members. The second array of gripping members of the first pawl is offset relative to the third array of gripping members of the second pawl. The offset of the second array of gripping members of the first pawl is relative to the gripping members of the second pawl providing for about doubling a gripping member ratchet pitch of the first array of gripping members of the ratchet to decrease an amount of a rotation of the wrench needed to rotatably displace a fastener in a confined space.

In another example embodiment, a wrench includes a ratchet mechanism arranged in an end of the wrench. The ratchet mechanism includes a ratchet rotatably displaceable in the end of the wrench, and a pawl displaceable in the end of the wrench. The pawl has a gripping surface that cooperates with the ratchet. The gripping surface of the pawl has an array of gripping members. The array of gripping members has a first curvilinear surface arranged in a first direction and a second curvilinear surface arranged in a second direction different than the first direction.

In yet another example embodiment, a wrench includes a ratchet mechanism arranged in an end of the wrench. The ratchet mechanism includes a pawl displaceable in the end of the wrench, and a ratchet rotatably displaceable in the end of the wrench. The ratchet includes an inside surface opposite an outside surface. The outside surface of the ratchet includes an array of gripping members that cooperate with an array of gripping members of the pawl. The array of gripping members of the ratchet has a first curvilinear surface arranged in a first direction and a second curvilinear surface arranged in a second direction.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
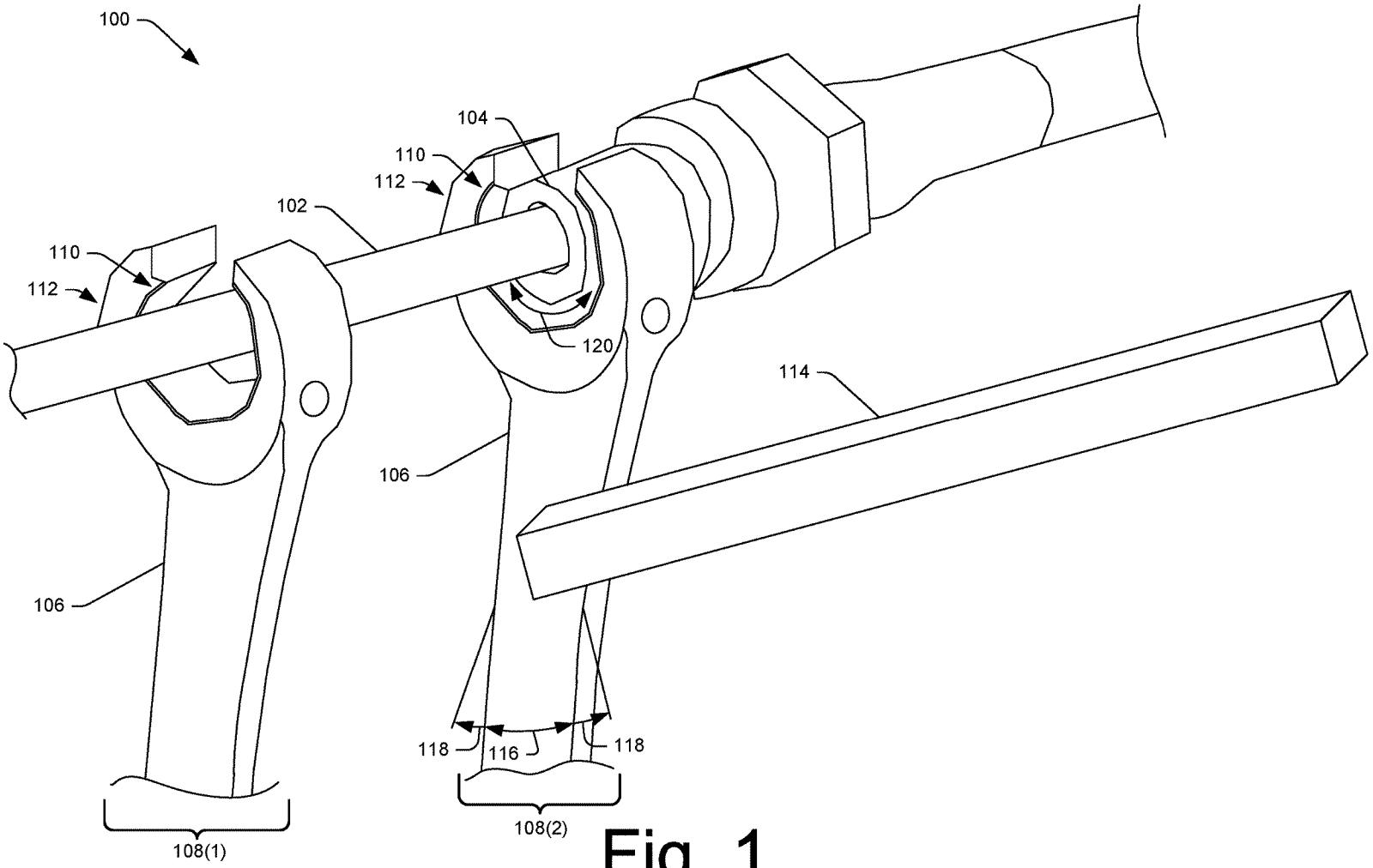
FIG. 1 illustrates an example confined space environment involving a line having a fitting coupled to the line.

This disclosure is directed to wrenches that loosen or tighten fasteners. In some instances, the wrench may include first and second pawls that are offset relative to each other to decrease an amount of a rotation of the wrench needed to rotatably displace a fastener. Furthermore, the wrench may include first and second pawls that are offset relative to each other to about double a gripping member (e.g., a projection, a cog, a tooth) pitch of a ratchet that cooperates with the first and second offset pawls, and thereby decrease an amount of a rotation of the wrench needed to rotatably displace a fastener. Moreover, the first and second pawls may each have an array of gripping members having a first curvilinear surface arranged in a first direction and a second curvilinear surface arranged in a second direction different than the first direction. The first and second curvilinear surfaces of each of the arrays of gripping members of the first and second pawls correspond and coact to increase a surface area of each array of gripping members of the first and second pawls that cooperates with an array of gripping members of the ratchet, and thereby increase the strength of the wrench for loosening or tightening a fastener.

While this application describes various embodiments of wrenches for use in the field of mechanics, this is by way of example and not limitation. For example, the wrenches may be used in other fields such as medical applications, plumbing applications, oil and/or gas applications, drilling applications, mining applications, etc. Additionally, and/or alternatively, the concepts and structures of the engagement between the pawl(s) and ratchet may be implemented in other devices for other purposes beyond the functionality of a wrench.

The wrench may include a ratchet mechanism arranged in an end of the wrench. The ratchet mechanism may include a ratchet, a first pawl, and a second pawl. For example, the ratchet mechanism may include a ratchet disposed in a first receptacle in the end of the wrench, a first pawl disposed in a second receptacle in the end of the wrench, and a second pawl disposed in a third receptacle in the end of the wrench. The ratchet may be rotatably displaceable in the first receptacle, and the ratchet includes an inside surface opposite an outside surface. The inside surface of the ratchet interfaces with a fastener, and the outside surface of the ratchet may include a first array of gripping members. The term, "array of gripping members," as used herein, may include an array of projections, an array of cogs, an array of teeth etc. In an example embodiment, where a wrench includes first and second pawls, the first pawl may be displaceable in the second receptacle and includes a second array of gripping members that cooperates with the first array of gripping members of the ratchet; and the second pawl may be displaceable in the third receptacle and includes a third array of gripping members that cooperates with the first array of gripping members of the ratchet. For example, the first pawl and second pawls may be linearly displaceable in the second and third receptacles and cooperate with the ratchet rotatably displaceable in the first receptacle.

Further, the second array of gripping members of the first pawl may be offset relative to the third array of gripping members of the second pawl. The offset of the second array of gripping members of the first pawl relative to the third array of gripping members of the second pawl may about double a gripping member ratchet pitch of the first array of gripping members of the ratchet. For example, the offset of the second array of gripping members of the first pawl relative to the third array of gripping members of the second pawl may be about half of at least one gripping member of the second array of gripping members of the first pawl and about half of at least one gripping member of the third array of gripping members of the second pawl.

Moreover, the first array of gripping members of the ratchet may have a first curvilinear surface arranged in a first direction and a second curvilinear surface arranged in a second direction, and the second array of gripping members of the first pawl and the third array of gripping members of the second pawl may have a corresponding first curvilinear surface arranged in the first direction and a corresponding second curvilinear surface arranged in the second direction. For example, the first array of gripping members of the ratchet may have a convex surface arranged in a first direction and a concave surface arranged in a second direction, and the second array of gripping members of the first pawl and the third array of gripping members of the second pawl may each have a convex surface arranged in the first direction and a concave surface arranged in the second direction.

Notably, all dimensions described herein, may vary depending on the overall size of the wrench, which varies in size according to the size of a fastener on which a selected wrench is to be used. Nevertheless, some specific dimensions of components are mentioned herein as examples, and relate to a ¾ inch wrench example.

Illustrative Wrenches

FIG. 1 illustrates an example environment 100 involving a line 102 having a fitting 104 coupled to the line 102. FIG. 1 illustrates an example wrench 106 in a first position 108(1) and in a second position 108(2). When in the first position 108(1), a ratchet mechanism 110 arranged in an end 112 of the wrench 106 receives the line 102, and when in the second position 108(2), the ratchet mechanism 110 interfaces with the fitting 104 coupled to the line 102.

The environment 100 may be, for example, a tight space, such as a transmission in a 4×4 pickup, and the line 102 may be a transmission line. In some instances, the environment may be, for example, an engine, a carburetor, a brake system, a power steering unit, a refrigeration system, etc., and the line 102 may be a fuel line, a brake fluid line, a power steering line, a pneumatic line, etc. Further, while FIG. 1 illustrates the fitting 104 being a flare nut, other fittings are contemplated. For example, the fitting 104 may be a compression fitting, a coupling, a hex nut, a jam nut, a cap, etc. While FIG. 1 illustrates one line 102 arranged in the environment 100, any number of lines may be arranged in the environment 100. For example, one or more additional lines may be positioned in close proximity of the line 102.

As an illustrative example, FIG. 1 illustrates environment 100 that is a confined space, where a mechanic is attempting to tighten or loosen the fitting 104 coupled to the line 102 with the wrench 106. Furthermore, FIG. 1 depicts an obstruction 114 positioned in close proximity of the line 102, thereby limiting the ability of the mechanic to rotate 116 the wrench 106 to only a few degrees 118. The obstruction 114 may be, for example, another line, a structural member, a part, a component, etc. immovably disposed in the confined space environment 100. FIG. 1 illustrates the ratchet mechanism 110 arranged in the end 112 of the wrench 106 as being rotatably displaceable 120 to rotatably displace the fitting 104 in the confined space environment 100. Further, because the fitting 104 may be, for example, a flare fitting or a flare nut formed of a soft material (e.g., brass, aluminum, copper, plastic, etc.), the ratchet mechanism 110 may provide a number of points of contact for a more secure grip on the soft fittings.

Figure 1A:
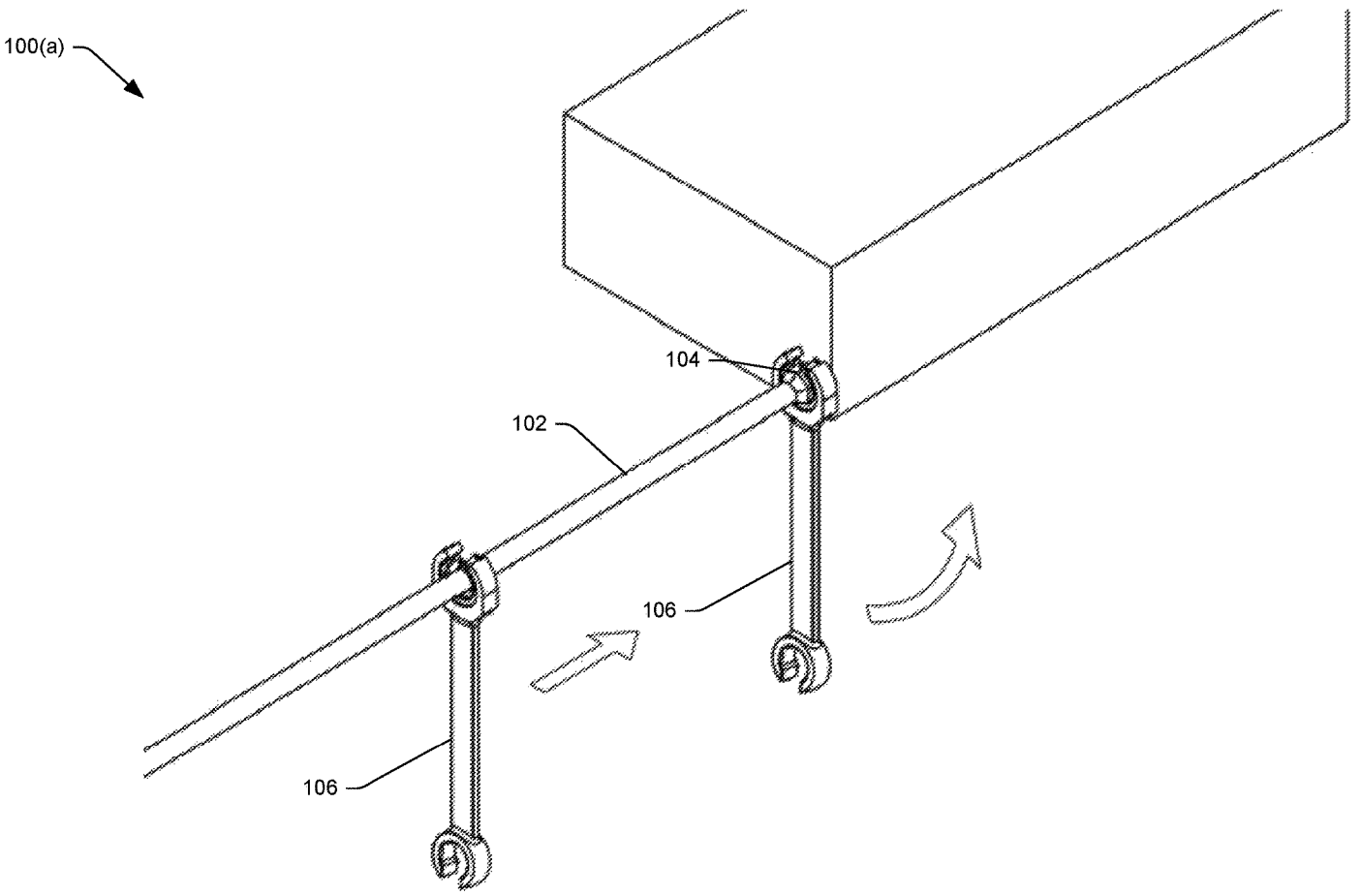
FIG. 1A illustrates another example confined space environment involving a line having a fitting coupled to the line.

FIG. 1A illustrates another example confined space environment 100(*a*) involving a line 102 having a fitting 104 coupled to the line 102. FIG. 1A illustrates a wrench 106 in a first position 108(1) and in a second position 108(2).

Figure 2:
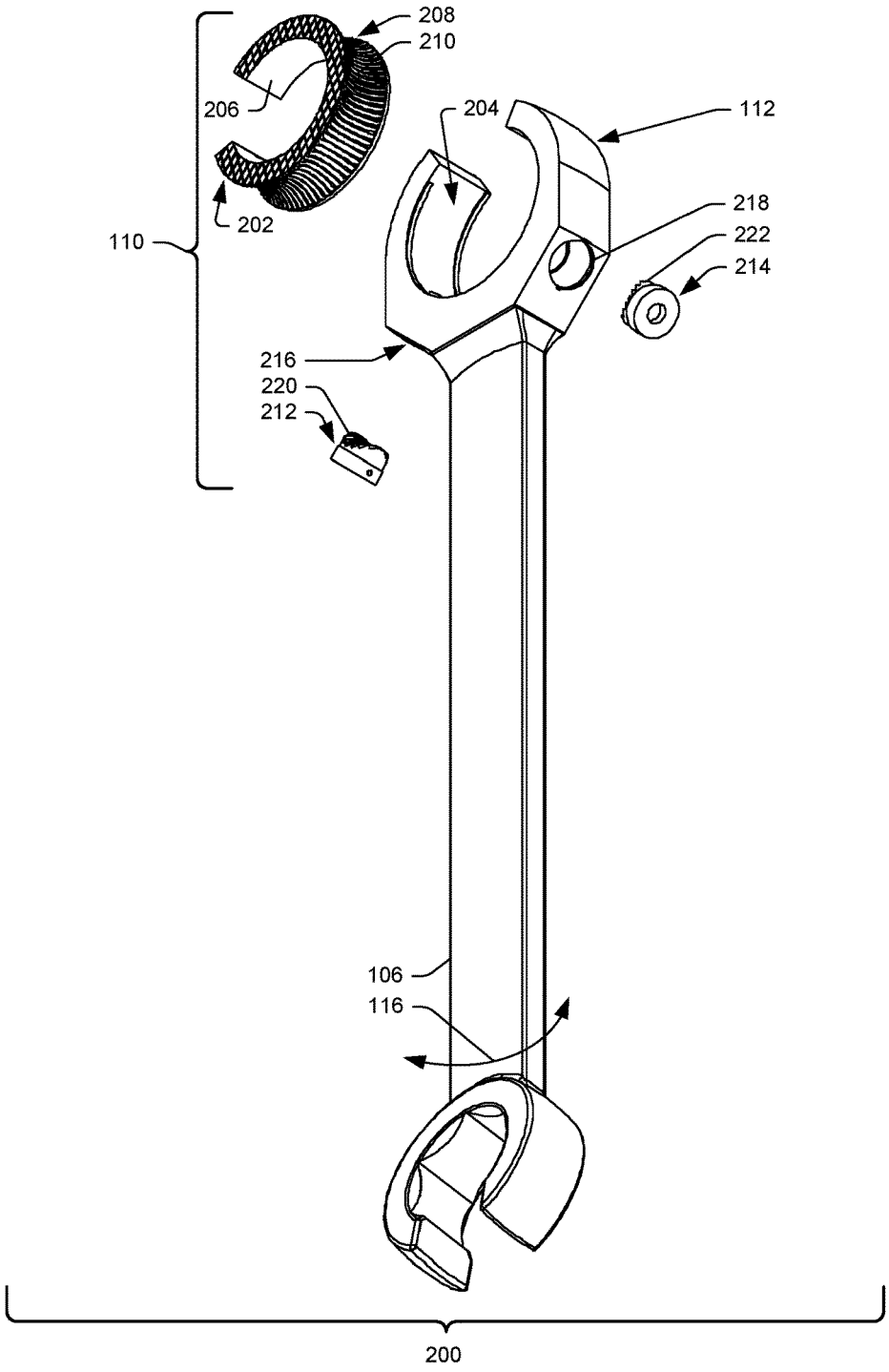
FIG. 2 illustrates an exploded assembly view of the example wrench shown in FIGS. 1 and 1A.

FIG. 2 illustrates an exploded assembly view 200 of the example wrench 106 shown in FIGS. 1 and 1A. The assembly view 200 illustrates the components of the ratchet mechanism 110 arrangeable in the end 112 of the wrench 106 in more detail. The assembly view 200 shows a ratchet 202 that may be disposed in a first receptacle 204 in the end 112 of the wrench 106. The ratchet 202 may be rotatably displaceable in the first receptacle 204. For example, the ratchet 202 may rotate in a clockwise or counterclockwise direction in the first receptacle 204 to loosen or tighten the fitting 104. The ratchet may include an inside surface 206 opposite an outside surface 208. The inside surface 206 of the ratchet 202 is configured to interface with the fitting 104. The outside surface 208 of the ratchet 202 includes a first array of gripping members 210.

The assembly view 200 illustrates that the ratchet mechanism 110 may include a first pawl 212 and a second pawl 214. The first pawl 212 may be disposed in a second receptacle 216 (hidden in this view) of the end 112 of the wrench 106, and the first pawl 212 may be displaceable in the second receptacle 216. For example, the first pawl 212 may be linearly displaceable in the second receptacle 216. The second pawl 214 may be disposed in a third receptacle 218. For example, the second pawl 214 may be linearly displaceable in the third receptacle 218.

The first pawl 212 disposed in the second receptacle 216 may include a gripping surface 220 that cooperates with the ratchet 202. For example, the gripping surface 220 of the first pawl 212 may include a second array of gripping members that cooperate with the first array of gripping members 210 of the ratchet 202. Similarly, the second pawl 214 disposed in the third receptacle 218 may include a gripping surface 222 that cooperates with the ratchet 202. For example, gripping surface 222 of the second pawl 214 may include a third array of gripping members that cooperate with the first array of gripping members 210 of the ratchet 202. The first and second pawls engage with the ratchet when the ratchet is rotatably displaced in a first direction (e.g., clockwise direction or counterclockwise direction), and do not engage with the ratchet when the ratchet is rotatably displaced in a second direction (e.g., clockwise direction or counterclockwise direction) opposite the first direction.

The second array of gripping members of the first pawl 212 may be offset relative to the third array of gripping members of the second pawl 214. For example, the first pawl 212 may be offset relative to the second pawl 214 by about a half of at least one gripping member of the second array of gripping members of the first pawl 212. Similarly, the second pawl 214 may be offset relative to the first pawl 212 by about half of at least one gripping member of the third array of gripping members of the second pawl 214. The offset of the first pawl 212 relative to the second pawl 214 approximately doubles a gripping member ratchet pitch of the first array of gripping members 210 of the ratchet 202. The gripping member ratchet pitch of the first array of gripping members 210 of the ratchet 202 cooperates with the first and second pawls 212 and 214, and decreases an amount of the rotation 116 of the wrench 106 needed to rotatably displace the fitting 104 in the confined space environment 100. For example, because the offset is about half of at least one gripping member of each of the second and third arrays of gripping members of the first and second pawls 212 and 214, respectively, the amount of the rotation 116 of the wrench 106 needed to rotatably displace the fitting 104 may be decreased by about half as much as existing wrenches. In some instances, the rotation 116 of the wrench 106 may be about 5 degrees. In other instances, the rotation 116 of the wrench 106 may be at least about 1 degree to at most about 10 degrees, or at least about 2.3° to at most about 4.6°. Moreover, because the offset of the first pawl 212 relative to the second pawl 214 about doubles a gripping member ratchet pitch of the first array of gripping members 210 of the ratchet 202, the gripping surface between the first and second pawls 212 and 214 and the ratchet 202 is maximized. The maximized surface area of the first and second pawls 212 and 214 and the ratchet 202 increases a strength of the cooperation of the gripping surface of each of the first and second pawls 212 and 214 and the ratchet 202, which increases an amount of torque the wrench 106 may apply without breaking. For example, with the increased strength of gripping surface of the first and second pawls 212 and 214 and the ratchet 202, the wrench 106 applies enough torque to loosen an overtightened fitting without breaking the ratchet mechanism 110.

Figure 3:
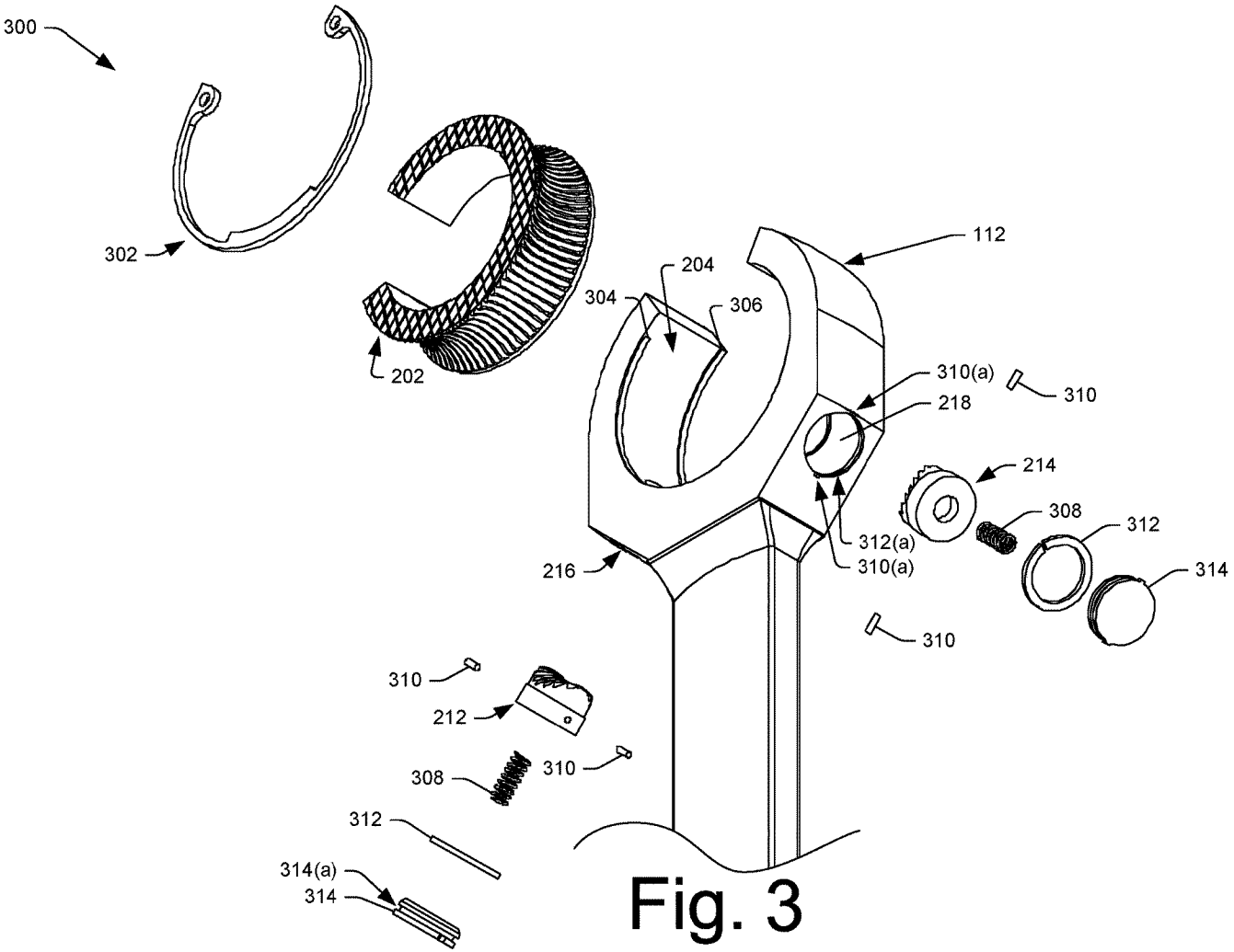
FIG. 3 illustrates a detail view of the exploded assembly of the ratchet mechanism arranged in the end of the wrench shown in FIG. 2.

FIG. 3 illustrates a detail view 300 of the exploded assembly of the ratchet mechanism 110 arranged in the end 112 of the wrench 106 shown in FIG. 2. Detail view 300 illustrates the ratchet mechanism 110 in more detail, and shows a retaining member 302 that retains the ratchet 202 in the first receptacle 204 in the end 112 of the wrench 106. While detail view 300 illustrates the retaining member 302 as an internal retaining ring, the retaining member 302 may be a snap ring, one or more pins, a cap, a flap, a wire lock, a lynch pin, a clevis pin, etc. Detail view 300 illustrates an opening 304 arranged in the end 112 of the wrench 106. The opening 304 may be a groove, a pocket, a channel, etc. arranged to receive the retaining member 302. When the retaining member 302 is disposed in the opening 304, the retaining member 302 retains or holds the ratchet 202 in the first receptacle 204, which includes a protrusion 306 against which the ratchet 202 rests. Thus, the retaining member 302 may retain the ratchet 202 in the first receptacle 204 such that the ratchet 202 is free to rotate in the first receptacle 204. In an example embodiment of a ¾" wrench, as depicted in FIG. 3, where the retaining member 302 is an internal retaining ring, the internal retaining ring may have an inner diameter of about 1.225 inches, an outer diameter of about 1.296 inches, and a thickness of about 0.035 inches, for example. Furthermore, the retaining member 302 may be sufficiently elastic so as to be removeably received by the opening 304. Thus, the ratchet 202 may be maintained, serviced, cleaned, replaced, etc. In some instances, the retaining member 302 may be placed and removed by pinching the sides of the retaining member 302 inwardly to flex the sides into or out of the opening 304.

Detail view 300 illustrates the ratchet mechanism 110 may include springs 308. The springs 308 are compressed to induce force on the first and second pawls 212 and 214 in a direction towards the ratchet 202. For example, the springs 308 may force the first and second pawls in a linear direction within the second and third receptacles 216 and 218 towards the ratchet 202. By displacing the first and second pawls 212 and 214 towards the ratchet 202, the second and third gripping surfaces 220 and 222 of the first and second pawls 212 and 214 cooperate and engage independently with the first array of gripping members 210 of the ratchet 202. Specifically, engagement occurs as each gripping member of the first array of gripping members 210 is rotatably displaced in a first direction (e.g., clockwise direction or counterclockwise direction) past each gripping member of the second and third gripping surfaces 220 and 222 of the first and second pawls 212 and 214. Correspondingly, when the first array of gripping members 210 of the ratchet 202 are rotatably displaced in a second direction (e.g., clockwise direction or counterclockwise direction), opposite to the first direction, the second and third gripping surfaces 220 and 222 of the first and second pawls 212 and 214 cooperate or engage independently with the first array of gripping members 210 of the ratchet 202 to catch against an angled edge of each of the gripping members, thereby locking the ratchet 202 against one of the first and second pawls 212 and 214 and preventing the ratchet 202 from being further rotatably displaced in the second direction. In some instances, the springs 308 may have a length of about 0.25 inches, an outside diameter of about 0.094 inches, and a wire diameter of about 0.012 inches.

While detail view 300 shows the first and second pawls being linearly displaced in the second and third receptacles 216 and 218, the first and/or second pawls may be displaced in other directions. For example, the springs 308 may force the first and/or second pawls about a pivot. For example, the first and/or second pawls may be pivotably attached in the end 112 of the wrench 106, and the springs 308 may force the first and/or second pawls about the pivots in a direction towards the ratchet 202. Moreover, while detail view 300 illustrates the first and second pawls having a cylindrical cross-sectional shapes, the first and second pawls may have other cross-sectional shapes. For example, the first and second pawls may have ovular, rectangular, triangular, conical, etc. cross-sectional shapes.

Detail view 300 illustrates the ratchet mechanism 110 may use pins 310, to guide the first and second pawls 212 and 214 in the second and third receptacles 216 and 218 and prevent the first and second pawls 212 and 214 from rotating in the second and third receptacles 216 and 218. For example, the pins 310 may be inserted into the first and second pawls 212 and 214 such that a portion of each of the pins 310 may protrude a distance from the first and second pawls 212 and 214. The protruding portion of the pins 310 are slideably received by correspondingly shaped receptacles 310(*a*), such as channels, grooves, slots, depressions, etc. arranged in the second and third receptacles 216 to prevent the first and second pawls 212 and 214 from rotating in the second and third receptacles 216. The pins 310 may have a length of about 0.095 inches and an outside diameter of about 0.031 inches. While detail view illustrates the ratchet mechanism 110 using pins 310, to guide the first and second pawls 212 and 214 in the second and third receptacles 216 and 218, the ratchet mechanism 110 may not use pins to guide the first and second pawls 212 and 214 in the second and third receptacles 216 and 218. Instead, in some instances, first and second pawls 212 and 214 may have an ovular or rectangular cross-sectional shape that cooperates with a similar cross-sectional shape of the second and third receptacles 216 and 218 to prevent the first and second pawls 212 and 214 from rotating in the second and third receptacles 216 and 218. In other instances, the second and third receptacles 216 and 218 may have one or more pins, ridges, nodules, rails, tangs, etc. arranged in the second and third receptacles 216 and 218 with which the first and second pawls 212 and 214 engage to prevent the first and second pawls 212 and 214 from rotating in the second and third receptacles 216 and 218.

Detail view 300 illustrates the ratchet mechanism 110 may include retaining members 312. Each retaining member 312 retains a plug 314 in the second and third receptacles 216 and 218. For example, each of the plugs 314 may be received by the second and third receptacles 216 and 218 to force the springs 308 onto each of the first and second pawls 212 and 214, and each of the retaining members 312 may be received by an opening 312(*a*) arranged in each of the second and third receptacles 216 and 218. The opening may be a groove, a pocket, a channel, etc. arranged to receive the retaining members 312. In an example embodiment of a wrench, the retaining members 312 may have an inside diameter of about 0.29 inches, an outside diameter of about 0.37 inches, and a thickness of about 0.025 inches. Similarly, in the above example embodiment of the wrench, the plugs 314 may have an outside diameter of about 0.325 inches and a thickness of about 0.093 inches. Each of the plugs 314 may have a pocket (not shown) to receive at least an end portion of the spring 308. Further, each of the plugs 314 may have a receptacle 314(*a*), such as groove, a pocket, a channel, etc. arranged to receive the retaining members 312. Additionally, the retaining members 312 may be sufficiently elastic that they may be flexed into and out of position with respect to plugs 314 and second and third receptacles 216 and 218.

It is further contemplated that the structure of the plugs 314 assembly may be such that the plugs 314 may be removeably received by the second and third receptacles 216 and 218, so that the first and/or second pawls 212 and 214, and the springs 308 could be maintained, serviced, cleaned, replaced, etc. While detail view 300 shows the ratchet mechanism 110 may use retaining members 312 and plugs 314 to retain the springs 308 and first and second pawls 212 and 214 in the second and third receptacles 216 and 218, the ratchet mechanism 110 may not use the retaining members 312 and plugs 314 to retain the springs 308 and first and second pawls 212 and 214 in the second and third receptacles 216 and 218. For example, instead, the second and third receptacles 216 and 218 may not be through holes. In some instances, the second and third receptacles 216 and 218 may be blind holes (not shown) having an open end opposite a closed end. The open end may be arranged adjacent to the receptacle 204 for the ratchet 202, and the closed end may be formed of the outside surface of the end 112 of the wrench 106.

Figure 4:
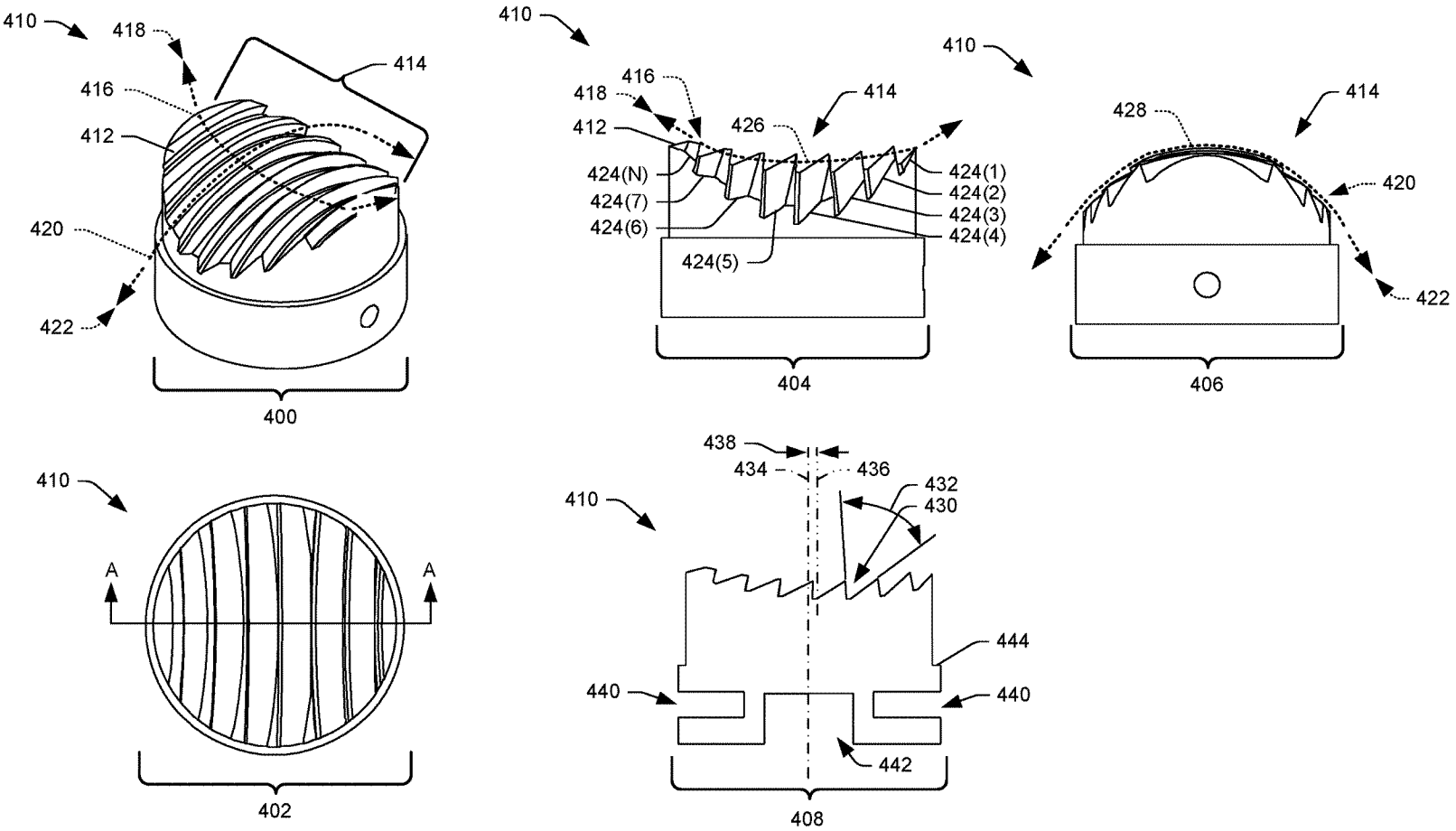
FIG. 4 illustrates a perspective view, a top view, side views, and a section view of an example pawl.

FIG. 4 illustrates a perspective view 400, a top view 402, side views 404 and 406, and a section view 408 of an example pawl 410. The example pawl 410 is an example of the first and second pawls 212 and 214 of FIGS. 2 and 3. The example pawl 410 may have an outside diameter of about 0.3 inches and a height of about 0.2 inches. Perspective view 400 shows a gripping surface 412 that cooperates with the ratchet 202. The gripping surface 412 of the pawl 410 may include a second array of gripping members 414 that cooperate with the first array of gripping members 210 of the ratchet 202. Perspective view 400 shows the second array of gripping members 414 may have a first curvilinear surface 416 arranged in a first direction 418 and a second curvilinear surface 420 arranged in a second direction 422 different than the first direction 418. Because the second array of gripping members 414 of the pawl 410 have the first curvilinear surface 416 in the first direction 418 and the second curvilinear surface 420 in the second direction 422, the gripping surface 412 of the pawl 410 is maximized. The maximized surface area of the gripping surface 412 of the pawl 410 may increase a strength of the cooperation of the gripping surface 412 of the pawl 410 with the first array of gripping members of the ratchet 202, which may increase an amount of torque the wrench 106 may apply without breaking. With the increased strength of the gripping surface 412 of the pawl 410 with the first array of gripping members of the ratchet 202, the wrench 106 may apply enough torque to loosen an overtightened fitting with greater ease compared to a conventional wrench, without breaking the ratchet mechanism 110, because the user can rely on the ratcheting action to reset the angle and reapply torque without spending time to remove the wrench off of the fitting and reapplying the wrench.

Side view 404 shows the second array of gripping members 414 having the first curvilinear surface 416 arranged in the first direction 418. The second array of gripping members 414 may be an array of projections, an array of cogs, an array of teeth etc. The second array of gripping members 414 may have a plurality of gripping members 424(1), 424(2), 424(3), 424(4), 424(5), 424(6), 424(7) and 424(N). For example, the second array of gripping members 414 may have a quantity of at least about 7.5 gripping members 424(1)-424(N). In one example, the gripping member 424 (N) may be approximately half of a full or complete gripping member. This half-gripping member step facilitates about double a ratchet pitch of the wrench 106. For example, the half-gripping member step facilitates about a first amount of rotation of the wrench 106, as compared to a second amount of rotation that is about double the first amount of rotation of a wrench without the half-gripping member step. The last gripping member 424(N) essentially has no impact on the ratchet pitch, and may provide less torque if shorter than the other gripping members. Instead, the ratchet pitch is facilitated by offsetting the second pawl by shifting the distance of half a tooth. That is, when the first pawl is fully engaged with the ratchet, the second pawl is offset a half of a gripping member to facilitate double the ratchet pitch.

Side view 404 shows the first curvilinear surface 416 may have a radius 426 of about 0.6 inches. The first curvilinear surface 416 may be a concave surface, where each of the gripping members 424(1)-424(N) define the concave surface. For example, each of the gripping members 424(1)-424(N) may be arranged such that an elevation or height of the gripping members with respect to the surface on the base of the pawl 410 varies, thereby providing for the first curvilinear surface 416 to have the concave shape in the first direction 418.

Side view 406 shows the second array of gripping members 414 having the second curvilinear surface 420 arranged in the second direction 422. Side view 406 shows the second curvilinear surface 420 may, in some instances, have a radius 428 of about 0.2 inches. Side view 406 shows the second curvilinear surface 420 may be a convex surface, where each of the gripping members 424(1)-424(N) have the radius 428. For example, each of the gripping members 424(1)-424(N) may have the radius 428 of about 0.2 inches that provides for the second curvilinear surface 420 to have the convex shape in the second direction 422.

Top view 402 shows a section line A-A taken proximate to a center of the pawl 410. Section view 408 shows the cross-section taken along the section line A-A and shows each of the gripping members 424(1)-424(N) may have an undercut 430 having an angle 432. In one example, the angle 432 of the undercut 430 may be about 60 degrees. In another example, the angle 432 of the undercut 430 may be at least about 45 degrees to at most about 75 degrees. In some instances, a 60 degree undercut 430 may provide for a maximum amount of surface area of each gripping member of the gripping members 424(1)-424(N) to engage with each gripping member of the first array of gripping members 210 of the ratchet 202, which may increase a strength of the cooperation of the gripping surface 412 of the pawl 410 with the first array of gripping members of the ratchet 202, and may increase an amount of torque the wrench 106 may apply without breaking. In one example, the second array of gripping members 414 may have a pitch of about 128 gripping members per inch, and each gripping member of the gripping members 424(1)-424(N) may have an undercut of at least about 45 degrees to at most about 75 degrees.

The section view 408 shows an axial centerline 434 of the pawl 410 and a center point line 436 of the ratchet 202. The center point line 436 representing a center point of the ratchet 202 discussed in more detail below with regards to FIGS. 5 and 6. The section view 408 shows an offset 438 of the axial centerline 434 of the pawl 410 relative to the center point line 436 of the ratchet 202 when the ratchet mechanism 110 is assembled in the first end 112 of the wrench 106. For example, when the ratchet mechanism 110 is assembled in the first end 112 of the wrench 106, the center point of the ratchet 202 and the axial centerline 434 of the pawl 410 are spaced a distance apart. In one example, the offset 438 of the axial centerline 434 of the pawl 410 relative to the center point line 436 of the ratchet 202 may be about 0.014 inches. In another example, the offset 438 of the axial centerline 434 of the pawl 410 relative to the center point line 436 of the ratchet 202 may be at least about 0.007 inches to at most about 0.03 inches.

In some examples, the offset 438 of the axial centerline 434 of the pawl 410 relative to the center point line 436 of the ratchet 202 may be accounted for when forming the gripping surface 412 of the pawl 410. In one example, the offset 438 may be taken into account when machining or cutting the second array of gripping members 414 having the first curvilinear surface 416 arranged in the first direction 418 and the second curvilinear surface 420 arranged in the second direction 422 different than the first direction 418. In another example, the offset 438 may be taken into account when casting or additively manufacturing (e.g., three-dimensionally printing) the second array of gripping members 414 having the first curvilinear surface 416 arranged in the first direction 418 and the second curvilinear surface 420 arranged in the second direction 422 different than the first direction 418.

Moreover, the offset 438 may be a second offset. For example, the offset of the gripping members of first pawl 212 relative to the gripping members of second pawl 214 may be a first offset, and the offset 438 of the of the axial centerline 434 of the pawl 410 relative to the center point line 436 of the ratchet 202 may be a second offset. For example, the first offset may be an offset of the gripping members of the first pawl relative to the gripping members of the second pawl, and the second offset may be an offset of each axial centerline of each of the first and second pawls relative to the center point of the ratchet.

Section view 408 further shows that pawl 410 may include receptacles 440 for receiving the pin 310 to guide pawl 410 in the second receptacle 216 or the third receptacle 218. The section view 408 also shows that pawl 410 may include a receptacle 442 for receiving at least a portion of the spring 308. The pawl 410 may include a shoulder 444 to interface or contact a shoulder arranged in the second receptacle 216 or the third receptacle 218 to prevent the pawl 410 and/or the spring 308 from being displaced out of the second receptacle 216 or the third receptacle 218. For example, in the event where the ratchet 202 is displaced from the first receptacle 204, or the ratchet 202 breaks apart, the shoulder 444 will retain the pawl 410, and the spring 308 in the second receptacle 216 or the third receptacle 218.

Figure 5:
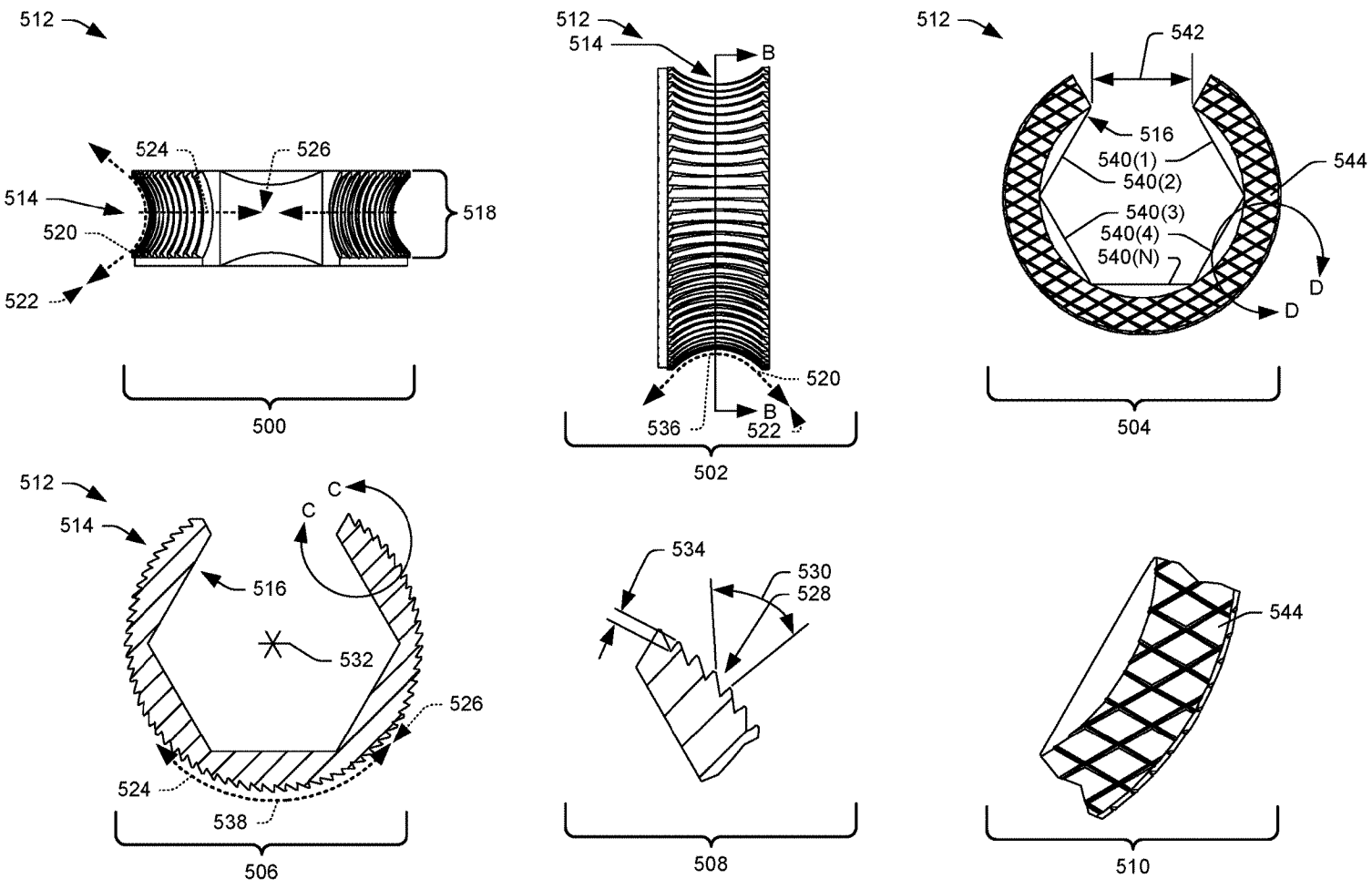
FIG. 5 illustrates a top view, side views, a section view, and detail views of an example ratchet.

FIG. 5 illustrates a top view 500, side views 502 and 504, a section view 506, and detail views 508 and 510 of an example ratchet 512. The example ratchet 512 is an example of the ratchet 202 of FIGS. 2 and 3. In some example embodiments, ratchet 512 may have an outside radius of about 0.6 inches, an inside radius of about 0.4 inches, and a thickness of about 0.4 inches. Top view 500, front view 502, and section view 506 show an outside surface 514 of the ratchet 512. Side view 504 and section view 506 shows an inside surface 516 of the ratchet 512, opposite to the outside surface 514 of ratchet 512. The inside surface 516 may be configured to interface with the fitting 104. The outside surface 514 of the ratchet 512 may include a first array of gripping members 518 to cooperate with the second array of gripping members 414 of the pawl 410. The first array of gripping members 518 of the ratchet 512 may have a first curvilinear surface 520 arranged in a first direction 522, and a second curvilinear surface 524 arranged in a second direction 526. Because the first array of gripping members 518 of the ratchet 512 have the first curvilinear surface 520 in the first direction 522 and the second curvilinear surface 524 in the second direction 526, a surface area of the first array of gripping members 518 of the ratchet 512 is maximized. The maximized surface area of the first array of gripping members 518 may increase a strength of the cooperation of the gripping surface 412 of the pawl 410 with the first array of gripping members 518 of the ratchet 512, which may increase an amount of torque the wrench 106 may apply without breaking.

Side view 502 shows a section line B-B taken proximate to a center of the ratchet 512. Section view 506 shows the cross-section taken along the section line B-B and shows the first array of gripping members 518 of the ratchet 512 may have about 64 gripping members that provide for a pitch of about 128 gripping members per inch. Because the first pawl 212 may be offset relative to the second pawl 214 by about a half of at least one gripping member, this facilitates the first array of gripping members 518 of the ratchet 512 to have the pitch of about 128 gripping members per inch.

Section view 506 shows a detail line C-C taken proximate to an end of the ratchet 512. Detail view 508 shows the detail of the section view taken along the detail line C-C and shows each gripping member of the first array of gripping members 518 may have an undercut 528 having an angle 530. In one example, the angle 530 of the undercut 528 may be about 60 degrees. In another example, the angle 530 of the undercut 528 may be at least about 45 degrees to at most about 75 degrees. A 60 degree undercut 528 may provide for a maximum amount of surface area of each gripping member of the gripping members 424(1)-424(N) of the pawl 410 to engage with each gripping member of the first array of gripping members 518 of the ratchet 512, which may increase a strength of the cooperation of the gripping surface 412 of the pawl 410 with the first array of gripping members of the ratchet 512, and may increase an amount of torque the wrench 106 may apply without breaking. Moreover, each gripping member of the first array of gripping members 518 may be aligned to a center point 532 of the ratchet 512. As discussed above, the center point line 436 represents the center point 532 of the ratchet 512, and when the ratchet mechanism 110 is assembled in the first end 112 of the wrench 106, the center point of the ratchet 512 and the axial centerline 434 of the pawl 410 are spaced a distance apart. Further, each gripping member of the first array of gripping members 518 may have a depth 534. In one example, the depth 534 may be about 0.022 inches. In another example, the depth 534 may be at least about 0.011 inches to at most about 0.033 inches.

Side view 502 shows the first curvilinear surface 520 arranged in the first direction 522. In some instances, the first curvilinear surface 520 may have a radius 536 of about 0.2 inches. Section view 506 shows the second curvilinear surface 524 arranged in the second direction 526. In some instances, the second curvilinear surface 524 may have a radius 538 of about 0.6 inches. The first curvilinear surface 520 may have a concave shape in the first direction 522, and the second curvilinear surface 524 may have a convex shape in the second direction 526.

Front view 504 shows faces 540(1), 540(2), 540(3), 540(4) and 540(N) arranged on the inside surface 516 of the ratchet 512 for contacting the fitting 104. For example, the fitting 104 may be a flare fitting or a flare nut formed of a soft material (e.g., brass, aluminum, copper, plastic, etc.), and the faces 540(1)-540(N) may comprise about five contact points for a more secure grip on the soft fitting. In one example, the faces 540(1)-540(N) may be separated by about ¾ inches. In another example, the faces 540(1)-540(N) may be separated by about ⅜ inches, ⅝ inches, ⅞ inches, 1⅛ inches, ¼ inches, 11/16 inches, 5/16 inches, 3/16 inches, 15/16 inches, 7/32 inches, 5/32 inches, 13/64 inches, 15/64 inches, 9/32 inches, 7/16 inches, 9/16 inches, etc. While FIG. 5 illustrates the faces 540(1)-540(N) as planar surfaces for interfacing with SAE or metric type fittings, the faces 540(1)-540(N) may be different shapes. For example, the faces 540(1)-540(N) may have a shape to fit hexalobular internal (e.g., Torx) type fittings. Front view 504 also shows a gap 542 arranged in the ratchet 512. In some instance, the gap 542 may be about 0.4 inches wide and provide for receiving the line 102. Front view 504 shows a detail line D-D taken proximate to side of the ratchet 512.

Detail view 510 shows the detail of the side of the ratchet 512 taken along the detail line D-D and shows a textured surface 544 on a side surface of the ratchet 512. The textured surface 544 to provide for a user to grip the ratchet 512 and rotatably displace the ratchet 512. For example, the textured surface 544 may provide for a thumb of a user to grip the ratchet 512 and rotatably displace the ratchet 512 in the confined space environment 100 involving the line 102 having the fitting 104 coupled to the line 102. The textured surface 544 may be, for example, an etching, a hatch, a cross hatch, a dimpling, knurling, a non-slip coating, etc.

Figure 6:
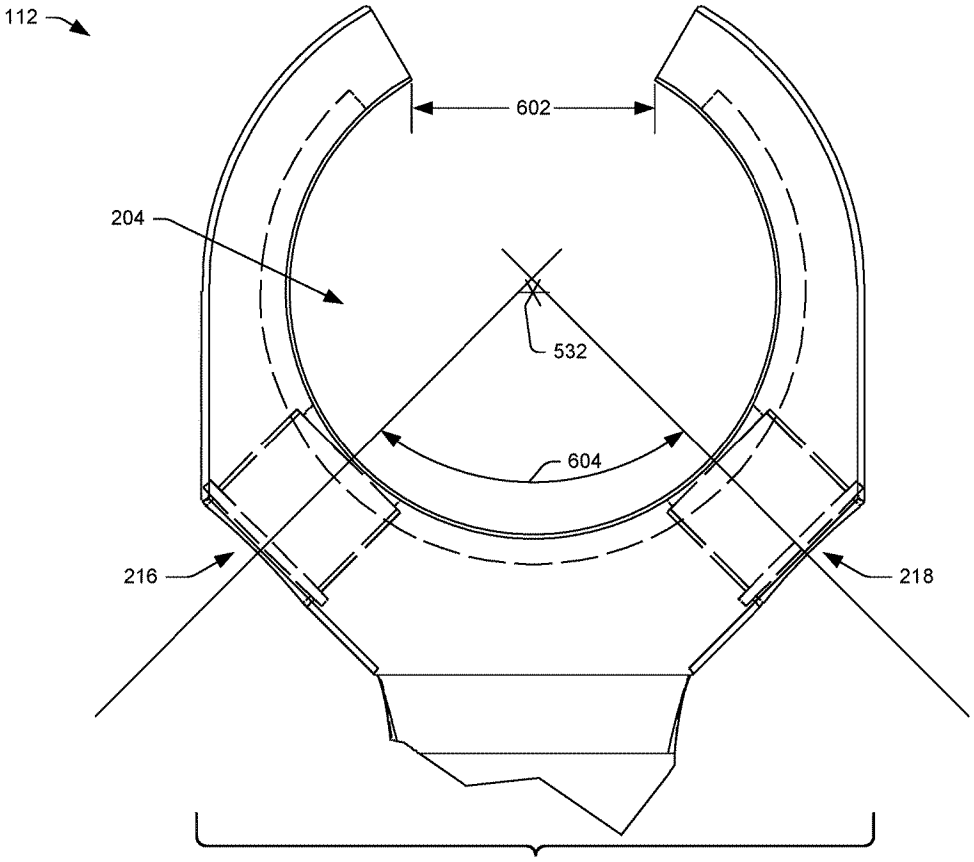
FIG. 6 illustrates a detail view of the end of the example wrench shown in FIGS. 1, 1A, 2, and 3.

FIG. 6 illustrates a detail view 600 of the end 112 of the example wrench 106 shown in FIGS. 1, 2 and 3. Detail view 600 shows the first receptacle 204 in the end 112 of the wrench 106, and the second and third receptacles 216 and 218 arranged in the end 112 of the wrench 106 opposite a gap 602 arranged in the end 112 of the wrench 106. Similar to the gap 542 arranged in the ratchet 512, the gap 602 may be approximately the same size as the gap 542 in the ratchet 512, and may provide for receiving the line 102.

Detail view 600 shows the second receptacle 216 and the third receptacle 218 may be arranged in the end 112 of the wrench 106 and are radially spaced by an angle 604 of about 90 degrees relative to each other. The first receptacle 204 may receive the ratchet 512 such that a center point 606 of the first receptacle 204 is centered with the center point 532 of the ratchet 512. When the ratchet 512 is disposed in the first receptacle 204, and first and second pawls 212 and 214 are disposed in the second and third receptacles 216 and 218, the center point 532 of the ratchet 512 and the axial centerlines 434 of the first and second pawls 212 and 214 have the offset 438.

Moreover, because the first and second pawls 212 and 214 are disposed in the second and third receptacles 216 and 218 opposite the gap 602, both of the first and second pawls 212 and 214 cooperate with the ratchet 512 at a time when first loosening the fitting 104. Because both of the first and second pawls 212 and 214 are cooperating with the ratchet 512 at a time of first loosening the fitting 104, both of the first and second pawls 212 and 214 work together using the maximized surface area between the first and second pawls 212 and 214 and the ratchet 202 to loosen the fitting 104.

Conclusion

Although the invention has been described in language specific to structural features and/or methodological acts, it is to be understood that the invention is not necessarily limited to the specific features or acts described. Rather, the specific features and acts are disclosed as illustrative forms of implementing the invention. For example, while embodiments are described having certain shapes, sizes, and configurations, these shapes, sizes, and configurations are merely illustrative.

What is claimed is:

1. a wrench for rotatably displacing a fitting, the wrench comprising:

a ratchet mechanism arranged in an end of the wrench, the ratchet mechanism including:

a ratchet disposed in a first receptacle in the end of the wrench, the first receptacle having a gap and the ratchet having a gap sized to correspond to a size of the gap of the first receptacle, the ratchet being rotatably displaceable in the first receptacle and including an inside surface opposite an outside surface, the inside surface of the ratchet being configured to interface with the fitting, and the outside surface of the ratchet including a first array of gripping members;

a second distinct receptacle located in a first side of the end of the wrench and directed radially inward toward the first receptacle;

a third distinct receptacle located in a second side of the end of the wrench and directed radially inward toward the first receptacle, wherein the second distinct receptacle and the third distinct receptacle are radially spaced apart about a center axis of the first receptacle, such that the second distinct receptacle is space apart from the gap of the first receptacle in a first direction, and the third distinct receptacle is spaced apart from the gap of the first receptacle in a second direction opposite the first direction;

a first pawl having an axial centerline and disposed in the second distinct receptacle of the end of the wrench, such that the axial centerline of the first pawl is directed radially inward toward the first receptacle, the first pawl being linearly displaceable, radially inward toward the first receptacle, in the second distinct receptacle and including:

a second array of gripping members to cooperate with the first array of gripping members of the ratchet, and a first protuberance engage with a slot in the second distinct receptacle such that the first protuberance linearly guides the first pawl, radially inward toward the first receptacle, in the second distinct receptacle and prevents the first pawl from rotating, about the axial centerline of the first pawl, in the second distinct receptacle;

a second pawl having an axial centerline and disposed in the third distinct receptacle of the end of the wrench, such that the axial centerline of the second pawl is directed radially inward toward the first receptacle, the second pawl being linearly displaceable, radially inward toward the first receptacle, in the third distinct receptacle and including:

a third array of gripping members to cooperate with the first array of gripping members of the ratchet, and a second protuberance engaged with a slot in the third distinct receptacle such that the second protuberance linearly guides the second pawl, radially inward toward the first receptacle, in the third distinct receptacle and prevents the second pawl from rotating, about the axial centerline of the second pawl, in the third distinct receptacle.

2. The wrench of claim 1, wherein the first array of gripping members of the ratchet has a first curvilinear surface arranged in a first direction and a second curvilinear surface arranged in a second direction.

3. The wrench of claim 2, wherein the first curvilinear surface comprises a convex surface, and the second curvilinear surface comprises a concave surface.

4. The wrench of claim 1, wherein the second array of gripping members comprises an array of projections, an array of cogs, or an array of teeth.

5. The wrench of claim 4, wherein each gripping member of the second array of gripping members has an undercut of at least about 45 degrees to at most about 75 degrees.

6. The wrench of claim 1, wherein a first curvilinear surface of the second array of gripping members comprises a radius of about 0.6 inches (15 millimeters), and a second curvilinear surface of the second array of gripping members comprises a radius of about 0.2 inches (5 millimeters).

7. The wrench of claim 6, wherein the first curvilinear surface of the second array of gripping members comprises a concave surface, and the second curvilinear surface of the second array of gripping members comprises a convex surface.

8. The wrench of claim 1, wherein the second array of gripping members of the first pawl has a first curvilinear surface arranged in a first direction and second curvilinear surface arranged in a second direction.

9. The wrench of claim 8, wherein the first curvilinear surface comprises a convex surface, and the second curvilinear surface comprises a concave surface.

10. The wrench of claim 1, wherein the third array of gripping members of the second pawl has a first curvilinear surface arranged in a first direction and a second curvilinear surface arranged in a second direction.

11. The wrench of claim 10, wherein the first curvilinear surface comprises a convex surface, and the second curvilinear surface comprises a concave surface.

12. A wrench for rotatably displacing a fitting, the wrench comprising:

a ratchet mechanism arranged in an end of the wrench, the ratchet mechanism including:

a ratchet disposed in a first receptacle in the end of the wrench, the ratchet rotatably displaceable about a center point of the first receptacle;

a second distinct receptacle located in a first side of the end of the wrench and directed radially inward toward the first receptacle;

a third distinct receptacle located in a second side of the end of the wrench and directed radially inward toward the first receptacle, wherein the second distinct receptacle and the third distinct receptacle are radially spaced apart about the center point of the first receptacle, such that the second distinct receptacle is spaced apart from the center point of the first receptacle in a first direction, and the third distinct receptacle is spaced apart from the center point of the first receptacle in a second direction opposite the first direction;

a first pawl having an axial centerline directed radially inward toward the first receptacle, the first pawl linearly displaceable, radially inward toward the first receptacle, in the second distinct receptacle, the first pawl including:

a first array of gripping members, and a first protuberance engaged with a first slot in the second distinct receptacle such that the first protuberance linearly guides the first pawl, radially inward toward the first receptacle, in the second distinct receptacle and prevents the first pawl from rotating, about the axial centerline of the first pawl, in the second distinct receptacle;

a second pawl having an axial centerline directed radially inward toward the first receptacle, the second pawl linearly displaceable, radially inward toward the first receptacle, in the third distinct receptacle, the second pawl including:

a second array of gripping members; and a second protuberance engage with a second slot in the third distinct receptacle such that the second protuberance linearly guides the second pawl, radially inward toward the first receptacle, in the third distinct receptacle and prevents the second pawl from rotating, about the axial centerline of the second pawl, in the third distinct receptacle; and wherein, the ratchet includes an inside surface opposite an outside surface, the inside surface of the ratchet configured to interface with the fitting, and the outside surface of the ratchet including a third array of gripping members to cooperate with the first array of gripping members and the second array of gripping members.

13. The wrench of claim 12, wherein the first array of gripping members comprises an array of projections, an array of cogs, or an array of teeth.

14. The wrench of claim 13, wherein each gripping member of the first array of gripping members has an undercut of at least about 45 degrees to at most about 75 degrees.

15. The wrench of claim 12, wherein the first array of gripping members has a first curvilinear surface arranged in a first direction and a second curvilinear surface arranged in a second direction different than the first direction, and wherein the first curvilinear surface comprises a radius of about 0.6 inches (15 millimeters) and the second curvilinear surface comprises a radius of about 0.2 inches (5 millimeters).

16. The wrench of claim 12, wherein the first array of gripping members has a first curvilinear surface arranged in a first direction and a second curvilinear surface arrange in a second direction different than the first direction, and wherein the first curvilinear surface comprises a convex surface, and the second curvilinear surface comprises a concave surface.

17. The wrench of claim 12, wherein the ratchet further includes a first side surface opposite a second side surface, and wherein at least one of the first side surface and the second side surface includes a textured surface, thereby increasing tactile friction for a user to rotatably displace the ratchet.

18. The wrench of claim 12, wherein the ratchet further includes a gap between a first end surface opposite a second end surface of the ratchet.

* * * * *